US009668307B2

(12) United States Patent
Roberts et al.

(10) Patent No.: US 9,668,307 B2
(45) Date of Patent: May 30, 2017

(54) WARM DIMMING FOR AN LED LIGHT SOURCE

(71) Applicant: GE Lighting Solutions, LLC, East Cleveland, OH (US)

(72) Inventors: Bruce Richard Roberts, Mentor-on-the-Lake, OH (US); Timothy Alan Taubert, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/809,892

(22) Filed: Jul. 27, 2015

(65) Prior Publication Data

US 2017/0034883 A1 Feb. 2, 2017

(51) Int. Cl.
*H05B 37/02* (2006.01)
*H05B 33/08* (2006.01)

(52) U.S. Cl.
CPC ..... *H05B 33/0815* (2013.01); *H05B 33/086* (2013.01); *H05B 33/0857* (2013.01)

(58) Field of Classification Search
CPC . H05B 37/02; H05B 33/0815; H05B 33/0857
USPC ..... 315/210, 224, 294, 192, 185 R, 186
See application file for complete search history.

(56) References Cited

U.S. PATENT DOCUMENTS 8,456,109 B1 6/2013 Wray
2012/0134148 A1 5/2012 Ter Weeme et al.
2013/0063035 A1* 3/2013 Baddela ..... H05B 33/0845 315/192
2013/0069561 A1 3/2013 Melanson et al.
2013/0221861 A1 8/2013 Creusen et al.
2013/0271018 A1* 10/2013 Luo ..... H05B 33/0824 315/192
2014/0210357 A1* 7/2014 Yan ..... H05B 33/0824 315/186
2015/0115816 A1* 4/2015 Bradford ..... H05B 33/083 315/192

FOREIGN PATENT DOCUMENTS

CN 103314640 A 9/2013

OTHER PUBLICATIONS

International Search Report and Written Opinion issued in connection with corresponding PCT Application No. PCT/US2016/043869 on Sep. 28, 2016.

* cited by examiner

*Primary Examiner* — Daniel D Chang
(74) *Attorney, Agent, or Firm* — GE Global Patent Operation; Peter T. DiMauro

(57) ABSTRACT

A lighting device includes a first LED light source having a first color temperature, a second LED light source having a second, lower color temperature connected in parallel with the first LED light source, and control circuitry operable to apply variable duty cycle frequency modulated power to the first LED light source while continuous power is provided to the second LED light source. A method of operating a lighting device includes providing variable duty cycle frequency modulated power to a first LED light source having a first color temperature, and providing continuous power to a second LED light source having a second, lower color temperature connected in parallel with the first LED light source.

20 Claims, 4 Drawing Sheets

WARM DIMMING FOR AN LED LIGHT SOURCE

FIELD OF THE INVENTION

The disclosed exemplary embodiments relate generally to lighting systems, and more particularly to dimmable light emitting diode (LED) lighting systems.

BACKGROUND OF THE INVENTION

Incandescent light bulbs create light by conducting electricity through a resistive filament, heating the filament to a very high temperature to produce visible light. Incandescent lamps typically include an enclosure with a tungsten filament inside and a base connector that provides both an electrical and structural support connection. Incandescent lamps are generally inefficient and require frequent replacement, and are in the process of being replaced by more efficient types of electric light such as fluorescent lamps, high-intensity discharge lamps, and, in particular, LEDs. However, when dimming an incandescent lamp, for example by decreasing the effective voltage or current through the lamp, the lamp emits a color temperature that shifts from a color temperature having a higher value, for example, 2700° K, toward a color temperature having a lower value, for example, 1700° K.

LED technology continues to advance resulting in improved efficiencies and lower costs with LEDs found in lighting applications ranging from small pin point sources to stadium lights. An LED light may be 5-10 times more efficient than an incandescent light. An LED light source may typically produce 90-150 lumens per watt (LPW) while an incandescent light source may typically produce 10-17 LPW. However, when dimmed, the light output is lowered but the color temperature of an LED typically remains substantially the same or may even shift to a slightly higher color temperature. Consumers generally prefer that a light source perform in a manner similar to an incandescent lamp and emit a color temperature that changes from a higher to lower value during dimming.

U.S. Application No. 2013/0221861 discloses LED segments with different color temperatures connected in series and powered by a rectified AC mains voltage. Power is supplied to a low color temperature segment and a number of additional segments with higher color temperatures are turned on at different levels as the amplitude of the rectified AC voltage increases and turned off at different levels as the amplitude decreases. The color temperature change of the LED segments when dimmed resembles the color temperature change of an incandescent lamp. Control circuitry and a number of switches or current controlled devices are required to determine the amplitude of the rectified AC voltage and to switch the different LED segments as the amplitude changes.

U.S. Application No. 2012/0134148 discloses a lighting device with at least two LEDs with different color temperatures and different luminous flux gradients as a function of junction temperature. The lighting device has no active components and the LEDs are selected according to their color temperature and luminous flux output so that in combination they will show a color temperature decrease as current through the device is decreased. A negative temperature coefficient resistor may be connected in series with at least one of the LEDs to achieve the desired color temperature change. The application requires that LEDs with different color temperatures be selected for specific luminous flux outputs in order to achieve the desired color temperature characteristics during dimming.

Many of the currently available solutions use a large number of additional components, multi-channel drivers and control circuitry to provide the preferred color temperature change. It would be advantageous to provide structures and techniques for decreasing the color temperature of an LED light source during dimming that overcome these and other disadvantages of the present art.

SUMMARY

The disclosed embodiments are directed to utilizing different color temperature LED sources to provide a lighting device that shifts to a lower color temperature upon dimming.

In at least one exemplary embodiment, a lighting device includes a first LED light source having a first color temperature, a second LED light source having a second, lower color temperature connected in parallel with the first LED light source, and control circuitry operable to apply variable duty cycle frequency modulated power to the first LED light source while continuous power is provided to the second LED light source.

In one or more exemplary embodiments, a method of operating a lighting device includes providing variable duty cycle frequency modulated power to a first LED light source having a first color temperature, and providing continuous power to a second LED light source having a second, lower color temperature connected in parallel with the first LED light source.

BRIEF DESCRIPTION OF THE DRAWINGS

The foregoing and other aspects of the disclosed embodiments are made more evident in the following Detailed Description, when read in conjunction with the attached Drawing Figures, wherein.

DETAILED DESCRIPTION OF THE INVENTION

Figure 1:
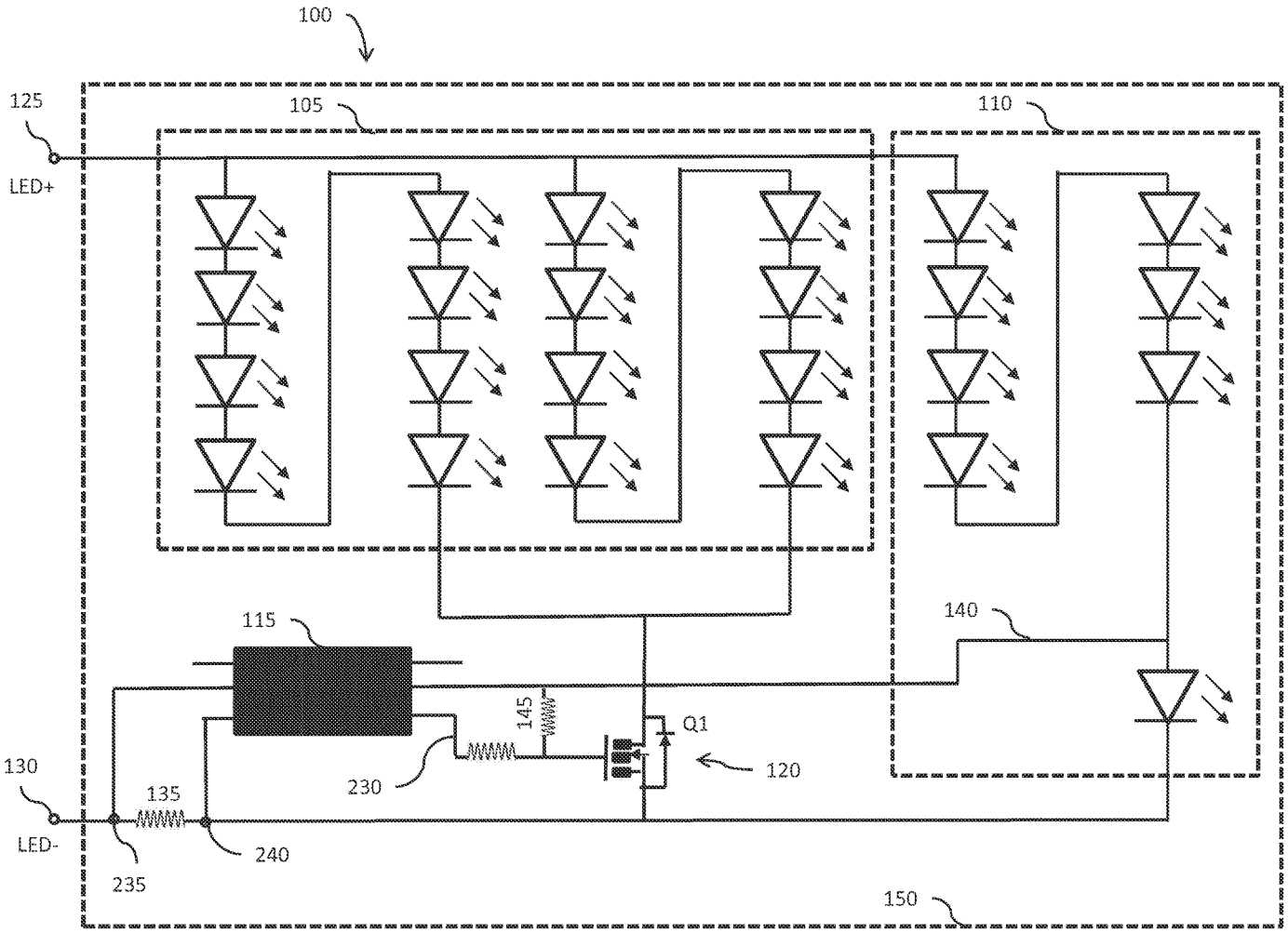
FIG. 1 shows a schematic diagram of a lighting device according to the disclosed embodiments.

FIG. 1 shows a lighting device 100 with a first LED light source comprising a first set of LEDs 105, a second LED light source comprising a second set of LEDs 110, a microcontroller 115, and a switch 120.

The first set of LEDs 105 may include one or more LEDs, and individual LEDs of the first set 105 may be connected together in series, parallel, or any combination of series and parallel. The first set of LEDs 105 may have an effective color temperature that is higher than the second set of LEDs 110. For example, the first set of LEDs 105 may have an effective color temperature of 3000° K. Individual ones of the LEDs may have different color temperatures so long as the effective color temperature of the first set 105 is higher than the effective color temperature of the second set 110.

The second set of LEDs may also include one or more LEDs and the individual LEDs of the second set 110 may be connected together in series, parallel, or any combination of series and parallel, but in at least one embodiment, the first set 105 and second set 110 of LEDs may be connected in parallel. The second set of LEDs 110 may have an effective color temperature that is lower than the first set of LEDs 105. For example, the second set of LEDs 110 may have an effective color temperature of 2000° K. Individual ones of the LEDs may have different color temperatures so long as the effective color temperature of the second set 110 is lower than the effective color temperature of the first set 105.

The switch 120 is connected in series with the first set of LEDs 105 and operates to modulate current applied to the first set of LEDs 105 under control of the microcontroller 115. The second set of LEDs is provided with continuous power. The switch 120 may be any suitable device for switching current, including a bipolar junction transistor, or field effect transistor. In at least one embodiment, switch 120 may be an N-Channel power MOSFET.

Figure 2:
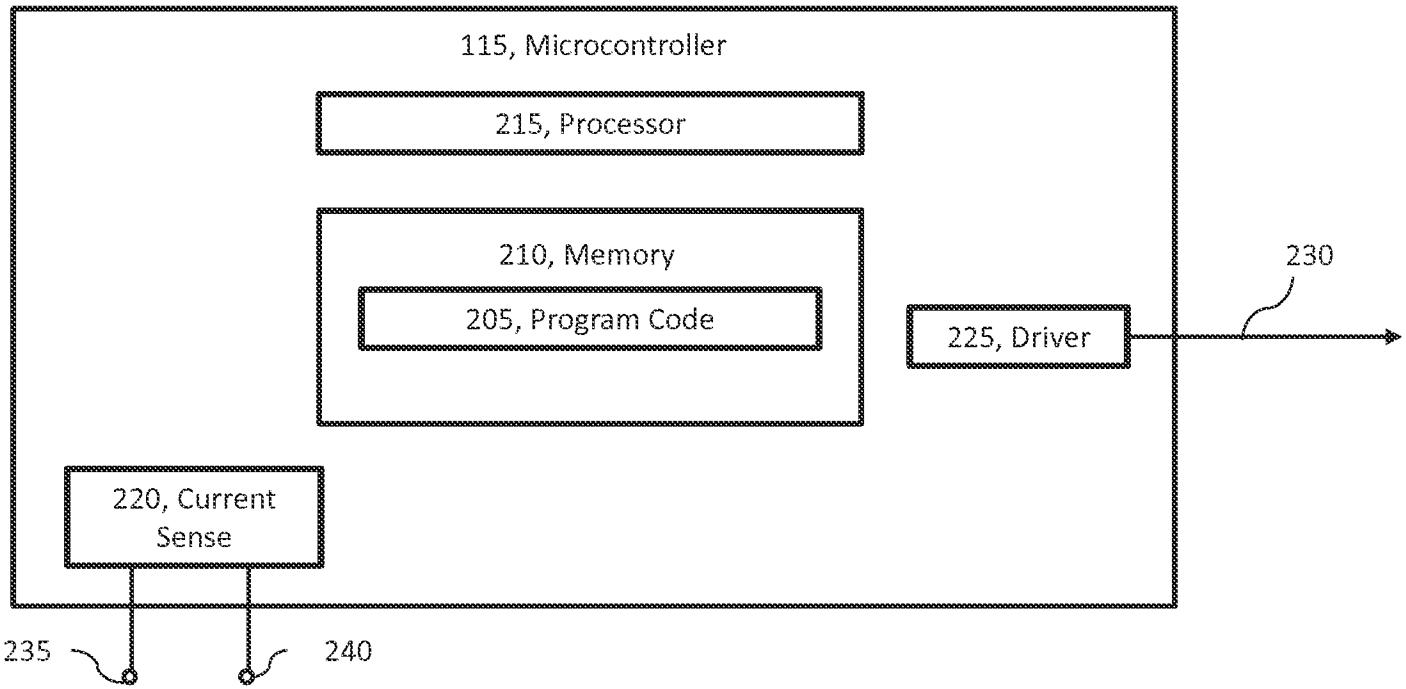
FIG. 2 illustrates a block diagram of a microcontroller for operating the lighting device according to the disclosed embodiments.

As shown in FIG. 2, the microcontroller 115 generally includes computer readable program code 205 stored on at least one computer readable medium for carrying out and executing the process steps described herein. The computer readable medium may be a memory 210 of the microcontroller 115. In alternate aspects, the computer readable program code may be stored in a memory external to, or remote from, the microcontroller 115. The memory 210 may include magnetic media, semiconductor media, optical media, or any media which is readable and executable by a computer. The microcontroller 115 may also include a processor 215 for executing the computer readable program code 205. In at least one aspect, the microcontroller 115 may include one or more input or output devices, including current sense circuitry 220 for determining current using terminals 235, 240, and a driver 225 for providing a signal 230 to drive switch 120.

Returning to FIG. 1, power may be supplied to the microcontroller 115 from the continuously powered second set of LEDs. For example, the microcontroller may be connected in parallel with one or more of individual ones of the second set of LEDs 110 using a conductor 140. Power for the lighting device 100 may be provided through terminals 125, 130 from, for example, a lamp driver (not shown) that provides power signals LED+ and LED−. The lamp driver, which may be external to the lighting device, may generally provide a full current level at 100% current for operating the lighting device 100, and may perform a dimming operation by decreasing the percentage of full current supplied to the lighting device 100. In response to the changing current supplied to the lighting device 100, the microcontroller 115 operates to change a proportion of current flowing through the first and second sets of LEDs as a function of the average current supplied by the lamp driver.

Control circuitry for the lighting device includes the microcontroller 115, resistors 135, 145, and the switch 120. Resistor 135 may be connected in series with the terminal 130 and to terminals 235, 240 for sensing a current provided to the lighting device 100. The microcontroller 115 operates to sample the voltage across the resistor 135 and calculate a running average of the current to eliminate any effects of current ripple. Based on the running average current calculations, the microcontroller 115 outputs the signal 230 for driving the switch 120. The microcontroller 115 generally provides signal 230 as a frequency modulated (FM) signal. The frequency of signal 230 may be calculated by the microcontroller 115 based on a percentage of full current supplied to the lighting device 100 by the lighting driver. In at least one embodiment, the microcontroller may provide signal 230 as an FM modulated signal with a fixed active, or on time, or as an FM modulated signal with a fixed inactive or off time. More specifically, for example, the signal 230 may be FM modulated by holding the active time constant and increasing and decreasing the inactive time as the current supplied to the lighting device 100 is decreased and increased, respectively. As another example, the signal 230 may be FM modulated signal by holding the inactive time constant and increasing and decreasing the active time as the current supplied to the lighting device 100 is increased and decreased, respectively. Resistor 145 provides a bias voltage for the switch 120, turning the switch 120 continuously on in the absence of signal 230.

As a result of the control circuitry 115, 135, 145, 120, the exemplary embodiments may operate in three modes depending on the percentage of full current supplied by the external lamp driver. For example, at full current, the switch 120 may be continuously conducting. At a first preselected current point, the microcontroller 115 provides the FM modulated signal 230 to the switch 120 to vary the current through the first set of LEDs 105. As the current supplied to the lighting device 100 drops, the frequency of the signal 230 is varied until a second preselected current point is reached, at which time the switch 120 is non-conducting and power is applied to only the second set of LEDs.

Figure 3:
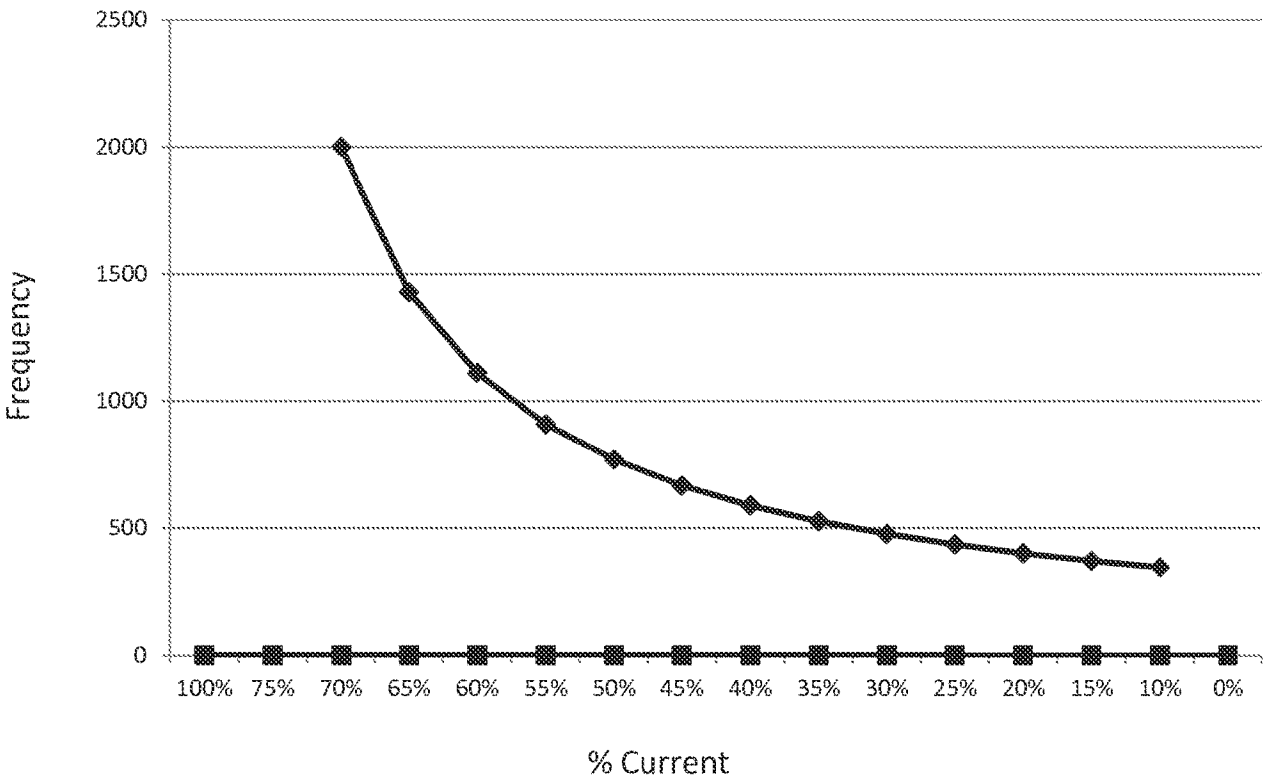
FIG. 3 shows some exemplary frequency values for driving a first set of LEDs according to the disclosed embodiments.

FIG. 3 shows some exemplary frequency values of the FM modulated signal 230 based on values of a percentage of full current supplied to the lighting device 100 and measured by the microcontroller 115. The disclosed values are approximate to account for variations in component values, component performance, environmental conditions, and other parameters that may affect the results. In this example, at full current, or 100% of the supplied current, signal 230 is continuously active and the switch 120 is continuously conducting. As the supplied current drops, for example, as a result of a dimming operation, to the first preselected current point of approximately 70% of full current, the microcontroller 115 generates signal 230 with a frequency of approximately 2 KHz. As the supplied current continues to drop, the microcontroller 115 generates frequencies according to a curved relationship, where at the second preselected current point of approximately 10% of full current, the frequency of signal 240 is approximately 345 Hz. In this example, when the current falls below 10% of full current, the microcontroller 115 forces signal 230 to an inactive state turning switch 120 off and rendering switch 120 no longer conductive.

Figure 4:
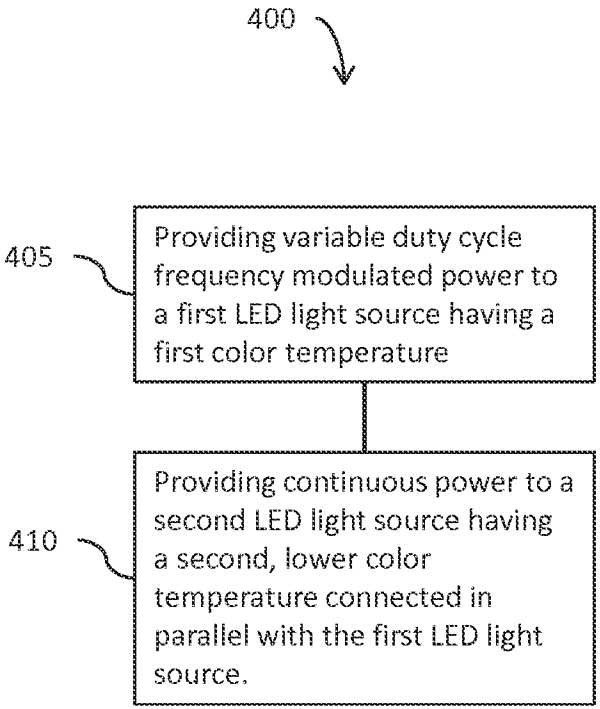
FIG. 4 shows a block diagram of a method according to the disclosed embodiments.

FIG. 4 shows a block diagram 400 of a method of operating the disclosed lighting device. Block 405 includes providing variable duty cycle frequency modulated power to a first LED light source, for example, first LED set 105, having a first color temperature. Block 410 includes providing continuous power to a second LED light source, for example, second LED set 110, having a second, lower color temperature connected in parallel with the first LED light source.

As mentioned above, the first color temperature of the first LED light source may be 3000° K, and the second color temperature of the second LED light source may be 2000° K. In addition, the frequency may be varied according to a percentage of current supplied to the lighting device, for example, as shown in FIG. 3.

In at least one embodiment, the first LED light source 105, the second LED light source 110, and the control circuitry 115, 135, 145, 120 may be mounted on a common mounting structure 150, for example, a printed circuit board, a wiring board, a frame, or any other suitable mounting structure.

The embodiments disclosed herein utilize different color temperature LED sources to provide a lighting device that shifts to a lower color temperature upon dimming. The microcontroller modulates a frequency of a signal driving a switch connected in series with a set of higher color temperature LED light sources, based on an average current provided to the LED light sources. The end result is a programmable variance in the color temperature as a function of drive current using a low number of components. Operation of a lamp driver providing power to the lighting device is unaffected by this switching and operates normally in decoding a phase cut dimming signal to drive current conversion. As mentioned above, the microcontroller 115 of the lighting device operates to change a proportion of current flowing through the first and second sets of LEDs as a function of the average current supplied by the external lamp driver. This allows the function provided by the control circuitry control circuitry 115, 135, 145, 120 to be added to an existing LED bulb, for example, by changing the LED light source mounting structure.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Furthermore, some of the features of the exemplary embodiments could be used to advantage without the corresponding use of other features. As such, the foregoing description should be considered as merely illustrative of the principles of the disclosed embodiments and not in limitation thereof.

What we claim is:

1. A lighting device comprising:

a first LED light source having a first color temperature;

a second LED light source having a second color temperature connected in parallel with the first LED light source, wherein the second color temperature is lower in value than the first color temperature; and a microcontroller with power connections directly in parallel with one or more LEDs of the second LED light source and operable to apply variable duty cycle frequency modulated power to the first LED light source while continuous power is provided to the second LED light source.

2. The lighting device of claim 1, wherein the first color temperature is 3000° K.

3. The lighting device of claim 1, wherein the second color temperature is 2000° K.

4. The lighting device of claim 1, wherein the microcontroller is operable to vary the frequency according to a percentage of current supplied to the lighting device.

5. The lighting device of claim 1, wherein the microcontroller is operable to increase the frequency as the percentage of current supplied to the lighting device increases and decrease the frequency as the percentage of current supplied to the lighting device decreases.

6. The lighting device of claim 5, wherein the microcontroller is operable to increase the frequency by holding an active time of the frequency modulated power constant while decreasing an inactive time of the frequency modulated power, and is operable to decrease the frequency by holding the active time constant while increasing the inactive time.

7. The lighting device of claim 5, wherein the microcontroller is operable to increase the frequency by holding an inactive time of the frequency modulated power constant while decreasing an active time of the frequency modulated power, and is operable to decrease the frequency by holding the inactive time constant while increasing the active time.

8. The lighting device of claim 5, wherein the microcontroller is operable to:

provide an FM signal to the first LED light source at a first preselected current point; and vary the FM signal until a second preselected current point is reached, wherein power is applied to only the second LED light source.

9. The lighting device of claim 8, wherein the first preselected current point is approximately 70% of full current supplied to the lighting device, and the second preselected current point is approximately 10% of full current supplied to the lighting device.

10. The lighting device of claim 9, wherein the microcontroller is operable to vary the frequency between approximately 2 KHz and 345 Hz as the percentage of current supplied to the lighting device varies between the first and second preselected current points, respectively.

11. The lighting device of claim 1, wherein the first LED light source, the second LED light source, and the microcontroller share a common mounting structure.

12. A method of operating a lighting device comprising:

using a microcontroller for providing variable duty cycle frequency modulated power to a first LED light source having a first color temperature;

providing continuous power to a second LED light source having a second color temperature connected in parallel with the first LED light source, wherein the second color temperature is lower in value than the first color temperature; and providing power to the microcontroller by connecting the microcontroller directly in parallel with one or more LEDs of the second LED light source.

13. The method of claim 12, wherein the first color temperature is 3000° K.

14. The method of claim 12, wherein the second color temperature is 2000° K.

15. The method of claim 12, comprising varying a frequency of the frequency modulated power according to a percentage of current supplied to the lighting device.

16. The method of claim 15, comprising increasing the frequency as the percentage of current supplied to the lighting device increases and decreasing the frequency as the percentage of current supplied to the lighting device decreases.

17. The method of claim 15, comprising:

providing an FM signal to the first LED light source at a first preselected current point; and varying the FM signal until a second preselected current point is reached, wherein power is applied to only the second LED light source.

18. The method of claim 17, wherein the first preselected current point is approximately 70% of full current supplied to the lighting device, and the second preselected current point is approximately 10% of full current supplied to the lighting device.

19. The method of claim 18, comprising varying the frequency between approximately 2 KHz and 345 Hz as the percentage of full current supplied to the lighting device varies between the first and second preselected current points, respectively.

20. The method of claim 12, comprising mounting the first LED light source, the second LED light source, and the microcontroller on a common mounting structure.

* * * * *